United States Patent [19]

Anderson

[11] Patent Number: 4,903,964

[45] Date of Patent: Feb. 27, 1990

[54] DETACHABLE NETTING FOR BASKETBALL GOAL

[76] Inventor: Gerald E. Anderson, 1342 S. Race St., Denver, Colo. 80210

[21] Appl. No.: 301,047

[22] Filed: Jan. 24, 1989

[51] Int. Cl.[4] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 2,884,249 | 4/1959 | Cunningham | 273/1.5 R |
| 3,160,414 | 12/1964 | Gray | 273/1.5 A |
| 4,086,269 | 4/1978 | Hill | 273/1.5 R |
| 4,145,044 | 3/1979 | Wilson et al. | 273/1.5 R |
| 4,793,611 | 12/1988 | Thornell | 273/1.5 R |
| 4,805,903 | 2/1989 | McArdle | 273/1.5 R |

*Primary Examiner*—Paul E. Shapiro
*Attorney, Agent, or Firm*—Beaton & Swanson

[57] ABSTRACT

A basketball net-attaching device for generally tubular netting with upper generally loop-shaped net strings or cords, the device having an annular rim-engaging portion of a diameter corresponding to that of the standard rim of a basketball goal, the member being of inverted channel-shaped configuration and detachably secured over the rim or hoop, and is notched for attaching the upper net strings to the device. The device is preferably mounted with the aid of a lifting tool which has a generally hook-shaped end and can advance the device upwardly through the center of the rim and then draw the annular rim-engaging portion downwardly into engagement with the rim so that the netting hangs downwardly from the rim.

6 Claims, 1 Drawing Sheet

DETACHABLE NETTING FOR BASKETBALL GOAL

This invention relates to basketball goals; and more particularly relates to a novel and improved device for releasably attaching a basketball net to a rim or goal.

BACKGROUND AND FIELD OF THE INVENTION

When basketball goals are set up, such as, on a playground, the netting may or may not be attached to the rim. Even when the netting is attached, it tends to deteriorate and lose its effectiveness over time and must be replaced. However, replacement of the nets is difficult because of the height of the goal and the need to loop or wind the upper cord portions of the netting through netholders on the goal.

Numerous appoaches have been taken to make provision for some type of a releasable net which can be removed from the goal when not in use and, for example, U.S. Pat. Nos. 2,579,312 to G. D. Garvey and 2,199,609 to J. H. Bennett disclose releasable straps and the like for direct but releasable attachment of a net to a basketball rim. However, both Garvey and Bennett require individual connection and release of each cord or string of the net and therefore in practice is quite time-consuming both in attaching to and releasing from the rim. Other patents, such as, those to K. J. Mahoney U.S. Pat. No. 4,353,548 and U.S. Pat. No. 3,085,800 to A. J. Holstad show unitary types of net support members to facilitate attachment of a net to a goal. Also, Holstad discloses the use of an elongated tool to permit attachment of a practice ring to a rim but also requires that the tool be permanently affixed to a lower end of the practice ring and does not provide for a unitary type of a net attachment device which will effectively duplicate the standard type of net but can be quickly attached and released.

Other patents of interest in this area are U.S. Pat. Nos. 1,544,453 to H. C. Harbison, 2,489,174 to J. H. Cunningham, 3,105,683 to H. E. Kimbrell, 3,204,957 to W. H. Logue, 3,313,539 to L. Michael, 3,814,359 to A. J. Powell, 4,082,269 to R. L. Hill, 4,145,044 to L. T. Wilson et al and 4,241,916 to R. J. Palm.

SUMMARY OF THE INVENTION

It is therefore an object of the present invention to provide for a novel and improved net-attaching device which facilitates releasable attachment of netting to a standard basketball rim.

Another object of the present invention is to provide for a novel and improved device to facilitate releasable attachment of a unitary net and attaching rim to the existing hoop or basketball goal.

A further object of the present invention is to provide for a novel and improved unitary net attaching device which can be quickly attached in place onto an existing hoop and removed in a one-step operation without use of a ladder and which obviates the practice of time-consuming threading of the net cords onto individual net holders.

In accordance with the present invention, a basketball net-attaching device has been devised for use with a standard basketball goal and wherein the device has a generally tubular netting with upper generally loop shaped net strings or cords, an annular rim-engaging portion of a diameter corresponding to that of the standard rim of a basketball goal, the member being of inverted channel-shaped configuration and detachably secured over the rim or hoop, and means for attaching the upper net strings to the annular member. The device is preferably mounted on the hoop with the aid of a lifting tool which has a generally hook-shaped end and can advance the device upwardly through the center of the hoop and then draw the annular rim-engaging portion or member downwardly into pressfit engagement with the upper surface of the hoop with the netting depending downwardly from beneath the hoop. In order to facilitate removal of the rim-engaging member from the hoop, a lifting tab may be provided and which is engageable by the lifting tool to remove the member from pressfit engagement with the rim and then completely release it from the goal.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
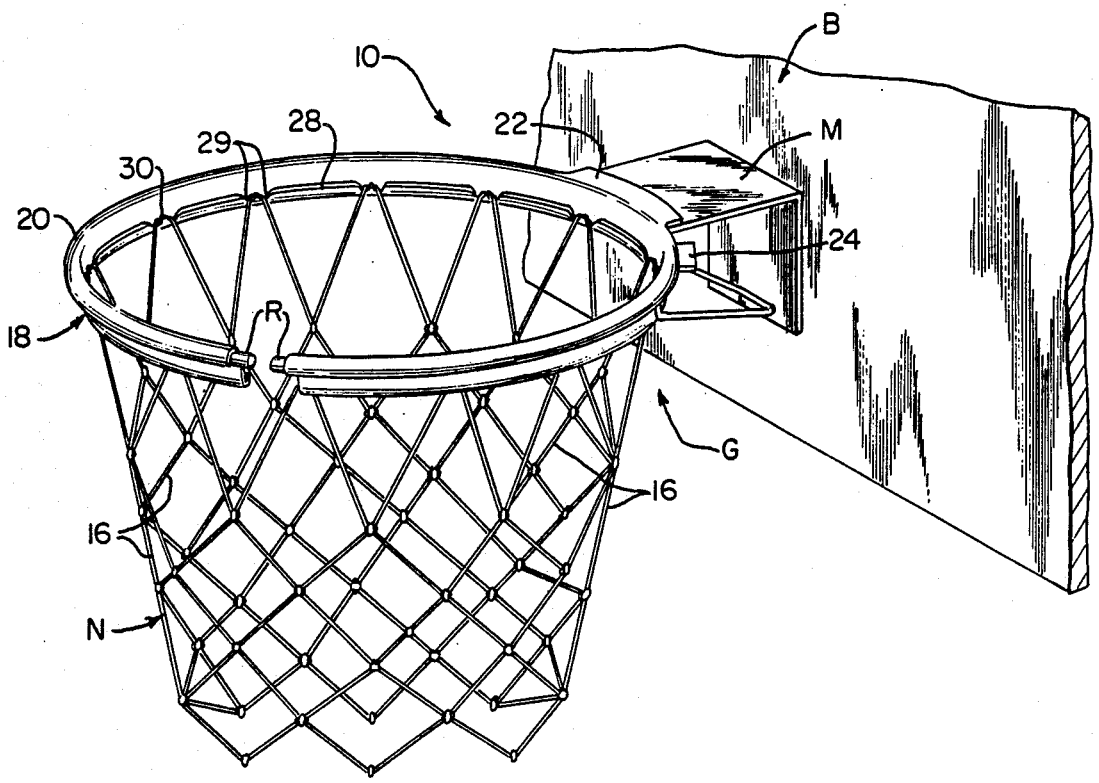
FIG. 1 is a somewhat perspective view of a preferred form of net-attaching device used in combination with a standard basketball goal.
Figure 2:
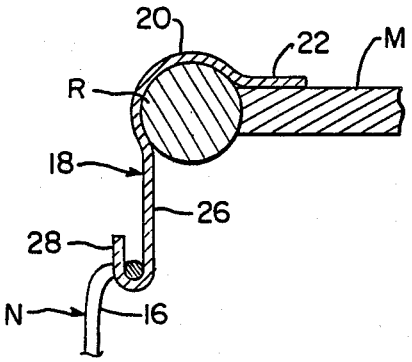
FIG. 2 is a cross-sectional view taken through one portion of the hoop and mounting bracket for attaching the hoop to a backboard.

Referring in more detail to the drawings, there is shown by way of illustrative example in FIG. 1 a basketball goal assembly G which is made up of a standard hoop or rim R and a mounting bracket M which is attached to a backboard B. Typically, in basketball gymnasiums, the backboard is suspended from the ceiling with the rim positioned at the standard 10′ height or elevation. For outdoor use, the backboard is usually positioned on a vertical pole or standard or mounted on the side of a garage or other building structure. Although the present invention is useful with any basketball goal assembly, it is most effecively employed in outdoor settings where it is desirable to be able to remove the net N from the goal when not in use so as to avoid any loss through pilferage or undue deterioration or wear and tear when left outdoors over extended periods of time.

Figure 3:
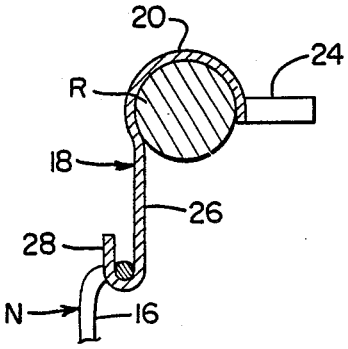
FIG. 3 is another cross-sectional view taken through the hoop and net-attaching device at a point away from the mounting bracket.

In accordance with the present invention, the preferred form of net-attaching device 10 comprises the generally tubular netting N which is of conventional construction and includes a series of intersecting strings or cords 14 including upper strands or cords 16 of inverted generally V-shaped configuration. Rather than to attach the upper strands 16 directly to the hoop, the netting N is suspended from an annular member 18 having an upper hoop-engaging portion 20 in the form of an inverted channel which conforms to the upper surface of the hoop R; and at the juncture of the hoop or rim R with the mounting bracket M the hoop-engaging portion is relieved slightly and provided with a shelf or lateral extension 22 which is supported by the upper surface of the mounting bracket M. In addition, one or more tabs or projections 24 are provided on the hoop-engaging portion 20, the tab 24 projecting in an outward radial direction as illustrated in FIGS. 1 and 3 to facilitate engagement by a suitable lifting tool to be hereinafter described, the tab being located at an outer terminal edge of the hook-engaging portion 20.

Figure 4:
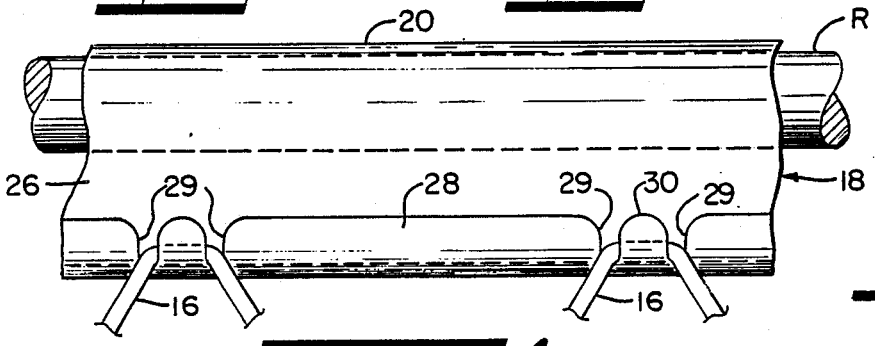
FIG. 4 is a somewhat fragmentary view in elevation of a portion of the hoop and showing the mounting of the upper string portions of a standard netting for the net-attaching device.

The annular member 18 also includes a downwardly depending flange 26 which forms essentially a downward vertical continuation from an inner edge of the hook-engaging portion beneath said rim R and terminates in a generally U-shaped trough portion 28 at its lower terminal end. The trough portion 28 is provided with circumferentially spaced notches 29 there being a pair of notches 29, in closely-spaced relation to one another at spaced circumferential intervals throughout the trough portion 28. The notches are directed or opened upwardly and are separated by a convex or rounded rib or finger 30 to facilitate insertion of an upper cord section or strand 16 of the net into each pair of notches, as illustrated in FIG. 4. It should be noted in this respect that the trough portions 28 may extend inwardly toward the center of the hoop, as shown, or be reversed to extend outwardly away from the center of the hoop.

The net attachment 18 is preferably composed of a plastic or plastic-like material which has limited flexibility, and the channel portion 20 is sized for pressfit engagement onto the rim R and is relatively thin-walled and curves downwardly into the flange portion 26. In this way, when the attachment 18 is installed on the rim, the rim-engaging portion 20 should be first aligned with the shelf 22 positioned over the mounting bracket M and the portion 20 then pressed downwardly into snug engagement with the rim R. Conversely, the attachment 18 can be released by pressing upwardly on the shelf portion 22 and tab 24 and lifting to peel the rim-engaging portion 20 away from the hoop. The attachment can then be dropped down through the center of the hoop or lifted away from the hoop and removed. The installation procedure as described can of course be done by persons of average height either by lifting on one shoulder's, using a step ladder or by a lifting tool 40 now to be described.

Figure 5:
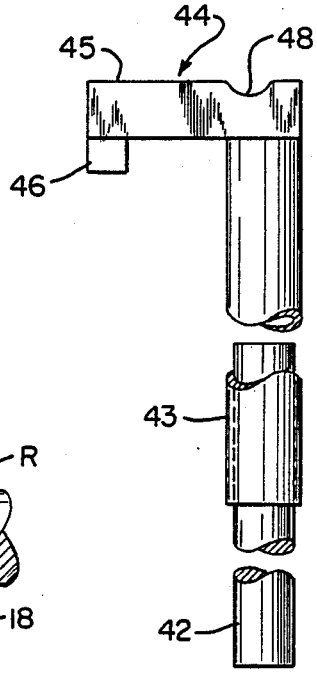
FIG. 5 is a front view in elevation of a lifting tool intended for use in attaching and releasing the net-attaching device with respect to the basketball goal.

The lifting tool 40 is illustrated in FIG. 5 and is broadly comprised of a telescoping pole or handle portion having inner and outer sections 42 and 43 and an upper generally hook-shaped portion 44 at the upper extremity of the telescoping portion 43. The hook-shaped end portion 44 includes a horizontal arm 45 terminating in a downwardly projecting lug 46, and a grooved portion 48 is provided on the upper surface of the arm 45. In order to install the attachment 18, the lower edge of the trough portion 28 may be positioned in the groove 48 to raise the attachment through the center of the rim until the entire attachment clears the rim R. The attachment is then aligned as described earlier to place the shelf 22 over the mounting bracket and the tool then released from engagement with the trough portion 28 and advanced upwardly over the rim-engaging portion 20. The underside of the arm 45 is brought into engagement with the upper surface of the portion 20 to press it downwardly at circumferentially spaced points around its entire periphery until the entire portion 20 is brought firmly into engagement with the rim. The lifting tool is then of course removed from the goal assembly and placed in an out-of-the-way position while the goal assembly is in use.

In order to remove the attachment 18, it is merely necessary to engage the tab or extension 24 with the upper surface of the lift arm 45 on the tool and to lift upwardly until the rim-engaging portion 20 is completely released from the rim. The underside of the arm 44 can then be hooked over the rim-engaging portion to draw it downwardly through the center of the hoop. In this relation, the attachment 18 has sufficient flexibility that it can be compressed slightly for advancing through the center of the hoop both in installation and release. It will be apparent, however, that the attachment may if desired be installed by passing it over the top of the rim and dropping the netting N downwardly through the center of the rim until the upper rim-engaging portion 20 moves into registry with the rim. Similarly, in releasing the attachment 18 from the rim R, the tool can be employed to raise or lift it away from the rim and drop it over one side.

It can be appreciated from the foregoing that various modifications may be made in the construction and arrangement of elements comprising the net attachment device without departing from the scope of the present invention. For example, it will be evident that the rim engagement portion 20 may be formed out of circumferential sections which are releasably interconnected or spaced from one another; also, that the rim-engaging portion 20 may extend over the external surface of the rim R with the flange 26 extending downwardly from the outer edge of the channel. Further, the tab or tabs 24 can be positioned at different selected points to facilitate removal or release of the portion 20 from engagement with the rim R. Furthermore, the cross-sectional configuration of the rim-engaging portion or channel 20 is shown as being generally semi-circular only to conform to the cross-section of the rim R but of course can be varied to conform to different cross-sectional configurations, such as, rectangular or oblong rim configurations.

It is therefore to be understood that the above and other modifications and changes may be made in the construction and arrangements of parts comprising the preferred form of invention without departing from the spirit and scope thereof as defined by the appended claims and reasonable equivalents thereof.

I claim:

1. In a basketball goal wherein a standard rim is mounted in an elevated position, the combination therewith comprising:

a generally tubular netting having upper net cords;

an annular member including a rim-engaging portion disposed in pressfit engagement with said rim, said portion being of channel-shaped, cross-sectional configuration detachably secured to and supported by said rim;

means for attaching said upper net cords to said annular member;

said goal includes a mounting bracket extending radially from said rim for attachment to a backboard, and a horizontal support bracket extending radially outwardly from said rim engaging portion and supported by said mounting bracket.

2. In a basketball goal according to claim 1, a radially extending tab portion on said annular member, and a lifting tool having a tab-engaging portion at its upper end.

3. In a basketball goal according to claim 2, said lifting tool including an elongated handle of a length to reach said basketball goal when in the elevated position, and said tab-engaging portion being in the form of an arm member extending from the upper end of said handle.

4. In a basketball goal wherein a standard hoop is mounted in an elevated position, the combination therewith comprising:

an annular member, said member including a hoop-securing portion of a diameter substantially corresponding to that of said hoop, and disposed in pressfit engagement with said hoop, said portion being of inverted, generally semi-circular cross-sectional configuration which is detachably secured to and supported by said hoop;

means for attaching said upper net cords to said annular member, said attaching means including cord-receiving notches at circumferentially spaced intervals beneath said annular member;

said basketball goal includes a mounting bracket extending radially from said hoop for attachment to a backboard, said annular member having a horizontal shelf extending radially outwardly from said hoop-engaging portion circumferentially aligned with said mounting bracket.

5. In a basketball goal according to claim 4, a lifting tool including an elongated handle of a length to reach said basketball goal, and an arm member extending laterally from the upper end of said handle and having a downwardly directed terminal end.

6. In a basketball goal according to claim 5, said arm member being recessed on its upper surface for engagement with said annular member in advancing it to a position above said hoop, and said arm member engageable with said hoop-securing portion to force it into pressfit engagement with said hoop.

* * * * *